United States Patent [19]

Sugihara et al.

[11] 4,041,914

[45] Aug. 16, 1977

[54] EXHAUST GAS RECIRCULATION SYSTEM WITH CONTROL APPARATUS FOR EXHAUST GAS FLOW CONTROL VALVE

[75] Inventors: Kunihiko Sugihara, Yokohama; Yasuo Nakajima, Yokosuka; Yoshimasa Hayashi, Yokohama, all of Japan

[73] Assignee: Nissan Motor Company, Limited, Japan

[21] Appl. No.: 588,238

[22] Filed: June 19, 1975

[30] Foreign Application Priority Data

June 25, 1974 Japan ..... 49-72460

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,739,797 | 6/1973 | Caldwell | 126/113 |
| 3,774,583 | 11/1973 | King | 123/119 A |
| 3,796,049 | 3/1974 | Hayashi | 96/1.5 |
| 3,814,070 | 6/1974 | Wertheimer | 123/119 A |
| 3,818,880 | 6/1974 | Dawson et al. | 123/119 A |
| 3,877,452 | 4/1975 | Nohira et al. | 123/119 A |
| 3,896,777 | 7/1975 | Masaki et al. | 123/119 A |
| 3,915,136 | 10/1975 | Caldwell | 123/119 A |
| 3,924,589 | 12/1975 | Nohira et al. | 123/119 A |
| 3,926,161 | 12/1975 | Wertheimer | 129/119 A |

*Primary Examiner*—Carroll B. Dority, Jr.
*Assistant Examiner*—David D. Reynolds
*Attorney, Agent, or Firm*—Robert E. Burns; Emmanuel J. Lobato; Bruce L. Adams

[57] ABSTRACT

An exhaust gas recirculation system comprises an exhaust gas flow control valve; a vacuum actuator for operation of the flow control valve; and a control apparatus for the vacuum actuator. The control apparatus comprises a vacuum regulator and a vacuum motor for actuating the vacuum regulator in response not only to the venturi vacuum but also to the intake manifold vacuum.

4 Claims, 3 Drawing Figures

EXHAUST GAS RECIRCULATION SYSTEM WITH CONTROL APPARATUS FOR EXHAUST GAS FLOW CONTROL VALVE

BACKGROUND OF THE INVENTION

The present invention relates to an exhaust gas recirculation system in an internal combustion engine, and more particularly to a control apparatus for an exhaust gas flow control valve of exhaust gas recirculation system.

Heretofore, there have been many proposals to introduce, throughout all operating conditions of an internal combustion engine, a substantially inert gas such as exhaust gas into the intake system; i.e. into the intake manifold or into the induction passage at a location downstream of the air filter; with the intention of reducing the concentration of nitrogen oxides ($No_x$) in the engine exhaust gases by suppressing their formation. It is required that a suitable amount of exhaust gas be introduced into the intake system of the engine to attain satisfactory results. A reduction in engine performance results if the ratio of the flow rate of recirculated exhaust gas to that of intake air exceeds a certain optimum value, and failure to suppress the formation of nitrogen oxides results if the ratio is much smaller than the certain optimum value. If intake manifold vacuum is employed to actuate a valve for controlling the flow of exhaust gas into the intake system of the engine, as is common in the prior art, it is hardly possible to maintain the flow rate ratio of recirculated exhaust gas to intake air at an optimum value mostly due to the fact that the vacuum in the intake manifold does not vary in proportion to the intake air flow rate throughout operation of the engine.

It has been confirmed that the vacuum in the venturi of a carburetor varies in relation to the velocity of air flowing through the venturi throughout operation of the engine, and therefore in relation to the flow rate of intake air being introduced into the engine. Thus, if the vacuum in the venturi is employed as a variable in controlling the amount of exhaust gas introduced into the intake system, the flow rate of exhaust gas can be metered to an optimum ratio to that of intake air throughout all modes of operation of the engine. However, the vacuum in the venturi is not strong enough for adequate control of a vacuum actuated valve to meter the flow rate of recirculated exhaust gas.

Conventionally, an exhaust gas recirculation system has a control apparatus providing a vacuum output which is an amplification of a vacuum in the venturi of a carburetor to a valve actuator of an exhaust gas flow control valve thereby to open an exhaust recirculation conduit responsive to changes in the venturi vacuum. When, in the conventional exhaust gas recirculation system, the intake manifold vacuum increases with the venturi vacuum remains unchanged, the flow rate ratio of recirculated exhaust gas to intake air increases above an optimum valve because flow rate of the exhaust gas through the recirculation conduit increases as the intake manifold increases even if the opening degree by the flow control valve is constant. Thus with the conventional exhaust gas recirculation system it is difficult to keep the flow rate of exhaust gas to an optimum ratio to that of intake air throughout all modes of operation of the engine. It is desirable that the opening degree of the flow control valve be decreased as the intake manifold vacuum increases or be increased as the intake manifold vacuum decreases so as to keep the flow rate ratio of recirculated exhaust gas to the venturi vacuum at an optimum value.

SUMMARY OF THE INVENTION

It is accordingly an object of the present invention to provide an exhaust gas recirculation system having a control apparatus which has a vacuum output which is an amplification of a vacuum in the venturi of a carburetor (the venturi vacuum) but modified by variation of a vacuum in the intake manifold vacuum (the intake manifold vacuum).

BRIEF DESCRIPTION OF THE DRAWINGS

The present invention will become clear as this description progresses with reference to the accompanying drawings, in which.

DESCRIPTION OF THE PREFERRED EMBODIMENT

Figure 1:
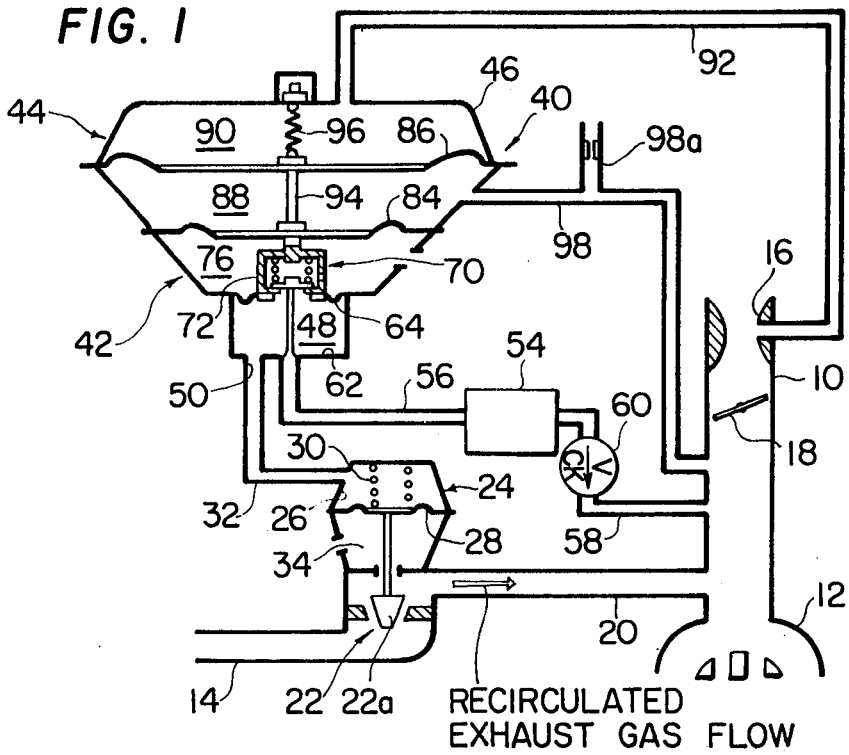
FIG. 1 is a schematic view of an exhaust gas recirculation system in accordance with the present invention.

Referring to FIG. 1 of the drawings, an exhaust gas recirculation system is shown as incorporated in an internal combustion engine which may be of any conventional design, being provided with a usual carburetor 10, an intake manifold 12, and an exhaust pipe 14 leading from an exhaust manifold (not shown). The carburetor 10 is provided with a venturi section 16 and a throttle flap 18.

The exhaust gas recirculation system includes an exhaust gas recirculation conduit 20 connecting the exhaust pipe 14 with the intake manifold 12 to recirculate a portion of the engine exhaust gas to the intake manifold 12. Mounted to the recirculation conduit 20 is an exhaust gas flow control valve 22 which normally closes the recirculation conduit 20. The valve 22 is urged toward its opening position by a valve actuator 24. The valve actuator 24 includes a vacuum chamber 26 and a flexible diaphragm 28 operatively connected to a valve member **22*a* to urge the valve member 22*a* against a compession spring 30 toward its opening position so as to open the recirculation conduit 20 in response to a vacuum in the vacuum chamber 26. The vacuum chamber 26 above the diaphragm 28 is connected by a vacuum conduit 32 to a control apparatus generally designated as 40, whereas a chamber 34 beneath the diaphragm 28** is open to the atmosphere as shown.

The degree of vacuum present in the vacuum chamber 26 is controlled by the control apparatus 40 comprised of a vacuum regulator 42 and a vacuum motor 44 for actuating the vacuum regulator 42. The vacuum regulator 42 and the vacuum motor 44 are combined in a unitary structure.

The control apparatus 40 includes a housing 46 having a vacuum regulating chamber 48. The vacuum regulating chamber 48 has an inlet port 50 connected to the vacuum chamber 34 of the valve actuator 24 through the vacuum conduit 32 for actuation of the diaphragm 28 by an output vacuum regulated in the vacuum regulating chamber 48 to operate the exhaust gas flow control valve 22. The regulating chamber 48 has also an outlet port 52 (see FIGS. 2 and 3) connected to a vacuum reservoir or source 54 by a vacuum pipe 56, the vacuum reservoir 54 being connected to the engine intake manifold 12 through a vacuum pipe 58 having a check valve 60.

The outlet port 52 is defined in an end portion of the vacuum pipe 56 projecting inwardly of the vacuum regulating chamber 48. The vacuum regulating chamber 48 is defined, on the side opposite wall 62, by a first flexible diaphragm means 64. The diaphragm 64 has an annular web portion 66 surrounding a central circular opening 68 therethrough (see FIGS. 2 and 3). Fixed securely to the upper side of the annular web portion 66 of the first diaphragm means 64 is a valve assembly 70 of the vacuum regulator 42. The valve assembly 70 includes a valve housing or cage 72 fixed securely to the annular web portion 66 to be movable therewith. The valve cage 72 has a bore 74 therein opening to an atmospheric pressure chamber 76 via an aperture 78 as shown and has an opening 80 through which the bore 74 communicates with the vacuum regulating chamber 48. A valve member 82 is disposed in the bore 74 and yieldably urged against the opening o80 by a compression spring 84 to close it. As will be understood from FIGS. 2 and 3 the valve cage 72 is movable with the first diaphragm 64 with the opening 80 for receiving the projecting end portion of the vacuum pipe 56 to bring the valve member 82 into and out of closing engagement with the outlet port 52. It will now be understood that the opening 80 serves as an air bleed port of the vacuum regulator chamber 48.

The valve cage 74 is actuated by the vacuum motor 44 comprising second and third flexible diaphragm means 84 and 86 mounted in the housing 46. The diaphragm 84 cooperates with the diaphragm 64 of the vacuum regulator 42 to define the atmospheric pressure chamber 76 in the housing 46 and between the diaphragms 64 and 84. The third diaphragm means 86 cooperates with the second diaphragm means 84 to form in the housing 46 and between them a biasing chamber 88 and the diaphragm 86 forms on an upper side or the opposite side of side exposed to the biasing chamber 88 and in the housing 46 a venturi vacuum chamber 90 communicating with the venturi section 16 of the carburetor 10 by means of a vacuum conduit 92. A rod 94 mechanically interconnects the diaphragms 84 and 86 and is integral with the valve cage 72. The valve cage 72 is thus movable in response to deflections of the diaphragms.

Figure 2:
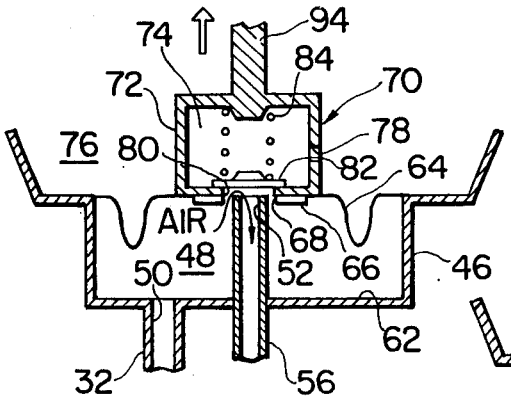
FIG. 2 is an enlarged fragmentary view of the control apparatus shown in FIG. 1.
Figure 3:
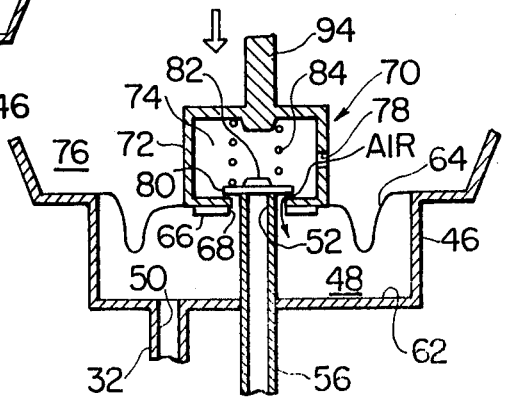
FIG. 3 is a view similar to FIG. 2 but showing parts in different operative positions.

When the valve cage 72 is raised by the diaphragms 84 and 88 to the position of FIG. 2, the vacuum pipe 56 is opened, thereby effecting the communication of the regulating chamber 48 with the vacuum reservoir 54. When the valve cage 72 is lowered the valve member 82 first closes on the end of the vacuum pipe 56, and further lowering of the valve cage 72 removes the opening 80 from the valve member 82 which opens communication of the vacuum regulating chamber 50 with the atmospheric pressure chamber 76 through the bore 74 and aperture 78. The reduction of the vacuum in the vacuum regulating chamber 48 by this action tends to cause the diaphragm 64 and the valve cage 72 to be moved upwardly, thereby sequentially closing the opening 80 on the valve member 82 and then removing the valve member 22 from the end or the outlet port 52 of the vacuum pipe 56, thereby again connecting the vacuum regulating chamber 48 with the vacuum reservoir 54. An equilibrium is established whereby a vacuum of a predetermined value is produced in the vacuum regulating chamber 48 according to an upward force applied to the valve cage 72 and the diaphragm 64.

To provide a vacuum output in the vacuum regulating chamber 48 which is an amplification of the venturi vacuum in the venturi vacuum chamber and acting on the upper side of the diaphragm 86, an effective area of the diaphragm 86 is formed to be considerably larger than that of the diaphragm 64 and a tension spring 96 mechanically bias the diaphragm 86 upwardly. The biasing chamber 88 is connected with the intake manifold 12 by a vacuum conduit 98 having an air bleeder orifice 98*a*. The air bleeder orifice 98*a* has a restriction chosen such that a vacuum in the biasing chamber 88 is a reduction of a vacuum in the intake manifold 12 and is considerably lower than a vacuum in the venturi vacuum chamber 90. It is necessary that an effective area of the third diaphragm means 86 ($S_3$)be larger than that of the second diaphragm means 84 ($S_2$). Thus the reduced manifold vacuum ($P_{88}$) in the biasing chamber 88 causes the rod 94 to urge downwardly with a force having a magnitude $P_{88}(S_3-S_2)$.

An equilibrium state is expressed by the following equation.

$$P_{48} \cdot S_1 + P_{88}(S_3 - S_2) = P_{90} \cdot S_3 + F \quad (1)$$

From the equation (1)

$$P_{48} = \frac{s_3}{s_1} \cdot P_{90} - \frac{s_3 - s_2}{s_1} \cdot P_{88} + \frac{F}{s_1} \quad (2)$$

where:

$P_{48}$ is the vacuum in the vacuum regulating chamber 48;

$P_{90}$ is the venturi vacuum in the venturi vacuum chamber 90;

$P_{88}$ is the reduced intake manifold vacuum in the biasing chamber 88;

$S_1$ is the effective area of the first diaphragm 64;

$S_2$ is the effective area of the second diaphragm 84;

$S_3$ is the effective area of the third diaphragm 86; and $F$ is the mechanical biasing force by the tension spring 96.

It will be understood that an upward force applied to the valve cage 72 and the first diaphragm 64 by the third diaphragm 86 due to the venturi vacuum $P_{90}$ and by the spring 96 is reduced as the intake manifold vacuum increases, thereby causing a corresponding reduction of vacuum $P_{48}$ in the vacuum regulating chamber 48. Thus it will now be appreciated that if the intake manifold vacuum increases with the venturi vacuum remained constant, the exhaust gas flow control valve 22 is caused to decrease the opening degree of the recirculation conduit 20.

It will now be understood that the vacuum $P_{48}$ in the vacuum regulating chamber 48 is variable only in response to the venturi vacuum $P_{90}$ as far as the reduced manifold vacuum $P_{88}$ is substantially at constant level, but the vacuum $P_{48}$ decreases as the reduced manifold vacuum $P_{88}$ increases or increases as the reduced manifold vacuum $P_{88}$ decreases even if the venturi vacuum $P_{90}$ is at a constant level. It will now be appreciated that the flow rate ratio of recirculated exhaust gas to the intake air is kept at an optimum value because the opening degree of the recirculation conduit 20 is appropriately varied responsive not only to the venturi vacuum but also to the intake manifold vacuum.

What is claimed is:

1. An exhaust gas recirculation system comprising:

a recirculation conduit to recirculate a portion of exhaust gas from the exhaust system of an internal combustion engine to the intake system having a carburetor and an intake manifold;

an exhaust gas flow control valve normally closing said recirculation conduit;

a valve actuator including a vacuum chamber and a diaphragm operatively connected to said exhaust gas flow control valve to urge said exhaust gas flow control valve toward its opening position so as to open said recirculation conduit responsive to a vacuum in the vacuum chamber of said valve actuator; and a control apparatus comprising:

a housing having a vacuum regulating chamber, said vacuum regulating chamber having an inlet port connected to the vacuum chamber of said valve actuator, an air bleed port and an outlet port connected to a vacuum reservoir;

a first flexible diaphragm defining a wall of said vacuum regulating chamber;

a second flexible diaphragm cooperating with said first diaphragm means to form in said housing and between said first and second diaphragms an atmospheric pressure chamber;

a third flexible diaphragm cooperating with said second diaphragm means to form in said housing and between said second and third diaphragms a biasing chamber, said third flexible diaphragm forming on the opposite side of a side exposed to said biasing chamber and in said housing a venturi vacuum chamber communicating with the venturi of the carburetor;

interconnecting means for mechanically interconnecting said first, second and third diaphragms, said interconnecting means including a valve means for selectively closing the air bleed port and said outlet port in response to deflections of said first, second and third diaphragms, and a vacuum conduit connecting said biasing chamber with the intake manifold;

an effective area of said third diaphragm being larger than that of said first diaphragm and than that of said second diaphragm, and said vacuum conduit including an air bleeder orifice having a restriction chosen such that a vacuum in said biasing means is a reduction of the intake manifold vacuum.

2. An exhaust gas recirculation system as claimed in claim 1, in which said first diaphragm means comprising an annular web portion surrounding a central circular opening therethrough, in which said outlet port is defined in a vacuum pipe projecting inwardly of said vacuum regulating chamber, and in which said valve means comprises:

a valve cage disposed in said atmospheric pressure chamber and fixed securely to the annular web portion of said first diaphragm means to be movable therewith, said valve cage having a bore therein opening to said atmospheric pressure chamber and an opening through which said bore communicates with said vacuum regulating chamber;

a valve member disposed in said bore of said valve cage and yieldably urged against the opening of said valve cage to close the same; and said valve cage being movable with said first diaphragm means with the opening of said valve cage for receiving said vacuum pipe projecting inwardly of said vacuum regulating chamber to bring said valve member into and out of closing engagement with said outlet port.

3. In an internal combustion engine having a carburetor provided with a venturi and a throttle valve, an intake manifold connected to the downstream side of the carburetor, and an exhaust manifold, an exhaust gas recirculation system comprising:

a recirculation conduit to recirculate a portion of exhaust gas in said exhaust manifold to said intake manifold;

an exhaust gas flow control valve normally closing said recirculation conduit to prevent recirculation;

a valve actuator including a vacuum chamber and a diaphragm operatively connected to said exhaust gas flow control valve to urge said exhaust gas flow control valve toward its open position so as to open said recirculation conduit responsive to a vacuum in the vacuum chamber of said valve actuator; and a control apparatus comprising:

a housing having a vacuum regulating chamber, said vacuum regulating chamber having an inlet port communicating with the vacuum chamber of said valve actuator, an air bleed port and an outlet port communicating with a vacuum reservoir;

a first diaphragm defining a wall of said vacuum regulating chamber;

a second diaphragm cooperating with said first diaphragm to form therebetween and in said housing an atmospheric chamber communicating with the atmosphere;

a third diaphragm cooperating with said second diaphragm to form therebetween and in said housing a biasing chamber, said third diaphragm forming on the opposite side of that side which is exposed to said biasing chamber and in said housing a venturi vacuum chamber;

interconnecting means interconnecting said first, second and third diaphragms so that central portions of said first, second and third diaphragms move in unison, said interconnecting means including a valve means for selectively closing the air bleed port and said outlet port in response to deflection of the central portions of said first, second and third diaphragms;

first vacuum conduit means for connecting the venturi vacuum at the venturi to said venturi vacuum chamber; and second vacuum conduit means for connecting the manifold vacuum in the intake manifold to said biasing chamber, an effective area of said third diaphragm exposed to said biasing chamber being larger than that of said second diaphragm exposed to said biasing chamber, and said second vacuum conduit means including an air bleeder orifice having a restriction chosen such that a vacuum in said biasing chamber is a reduction of the manifold vacuum.

4. An exhaust gas recirculation system as claimed in claim 3, in which said first diaphragm comprises an annular web portion having a central circular opening therethrough, a vacuum pipe projecting into said vacuum regulating chamber, and defining said outlet port; in which said valve means comprises;

a valve cage disposed in said atmospheric chamber and fixed securely to the annular web portion of said first diaphragm to be movable therewith, said valve cage having a bore therein opening to said atmospheric chamber and an opening through which said bore communicates with said vacuum regulating chamber; and a valve member disposed in said bore of said valve cage and yieldably urged against the opening of said valve cage to close the same;

said valve cage being movable with said first diaphragm with the opening of said valve cage for receiving said vacuum pipe projecting into said vacuum regulating chamber to bring said valve member into and out of closing engagement with said outlet port.

* * * * *